US006218651B1

(12) United States Patent
Chung

(10) Patent No.: US 6,218,651 B1
(45) Date of Patent: Apr. 17, 2001

(54) MICROWAVE OVEN

(75) Inventor: Chong-mo Chung, Suwon (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/649,137

(22) Filed: Aug. 28, 2000

(30) Foreign Application Priority Data

Nov. 17, 1999 (KR) ..... 99-51099

(51) Int. Cl.[7] ..... H05B 6/64

(52) U.S. Cl. ..... 219/681; 219/685; 219/757; 219/400; 126/21 A

(58) Field of Search ..... 219/681, 682, 219/685, 757, 400; 126/21 A, 21 R

(56) References Cited

U.S. PATENT DOCUMENTS 4,283,614 * 8/1981 Tanaka et al. ..... 219/681

4,780,596 * 10/1988 Matsushima et al. ..... 219/400

FOREIGN PATENT DOCUMENTS 63-70030 * 3/1988 (JP) ..... 126/21 A

* cited by examiner

*Primary Examiner*—Philip H. Leung
(74) *Attorney, Agent, or Firm*—Robert E. Bushnell, Esq.

(57) ABSTRACT

A microwave oven having a cooking chamber and a fan housing, both of which are isolated by a partition is provided. The microwave oven includes a heater housing depressed from the partition toward the fan housing and having at least one air discharge hole formed thereon. The air discharge hole communicates with the fan housing and a convection heater is housed in the heater housing. A fan is installed in the fan housing blowing air from the fan housing into the cooking chamber through the air discharge hole and the convection heater. With this configuration, loss of heat is reduced, thereby improving the efficiency of cooking and reducing the cost of production.

20 Claims, 5 Drawing Sheets

MICROWAVE OVEN

CLAIM OF PRIORITY

This application makes reference to, incorporates the same herein, and claims all benefits accruing under 35 U.S.C. §119 from my application MICROWAVE OVEN filed with the Korean Industrial Property Office on Nov. 17, 1999 and there duly assigned Ser. No. 51099/1999.

BACKGROUND OF THE INVENTION

1. Field of the Invention

The present invention relates to a microwave oven, and more particularly, an improved microwave oven having a cooking chamber, a fan housing attached to the cooking chamber, and a convection heater mounted on an air passageway formed between the cooking chamber and the fan housing.

2. Description of the Related Art

A microwave oven having a convection heater has been used for efficiently cooking food placed in a cooking chamber while the food is cooked by microwaves. Typically, the convection heater is mounted on a sidewall of a fan housing attached to the cooking chamber. For example, a conventional microwave oven shown in FIGS. 1 and 2 includes a main body 101 and a cooking chamber 103 formed in the main body 101. In the front of the main body 101 are provided a door 105 opening and closing the cooking chamber 103 and a control panel 107 operating the microwave oven. In the rear of the control panel 107 is formed a component chamber in which a number of components operating cooking functions of the microwave oven are installed.

On the bottom of the cooking chamber 103, a circular tray 109 on which the food is put is rotatably installed. The circular tray 109 is rotated by a driving motor not shown. A fan housing 130 is formed at the rear of the cooking chamber 103 and between a partition 110 and a heater casing 131. In the fan housing 130 are installed a convection heater 121 generating heat by means of an external power supply and a ventilator sending air heated by the convection heater 121 into the cooking chamber 103.

On the partition 110 are formed a number of air suction holes 111 and air discharge holes 123 circulating air heated by the convection heater 121 between the cooking chamber 103 and the fan housing 131. The air suction holes 111 are formed in the central area of the partition 110 and are in communication with the fan housing 130. The air discharge holes 123 are formed along the circumferential area of the partition 110 and are in communication with the fan housing 130. The convection heater 121 having a form of loop mounted adjacent to the air discharge holes 123 on the partition 110 and is fixed on the back face of the partition 110 by a plurality of brackets 135. The fan 133 mounted on heater casing 131 is disposed in the rear area of the convection heater 121 and adjacent to the air suction holes 111 formed on the partition 110 to suck the air from cooking chamber 103 into the inside of the fan housing 130 through the air suction holes 111 and blow the air sucked into the fan housing 130 toward the air discharge holes 123.

With this configuration, when the microwave oven operates, the convection heater 121 heats the air within the fan housing 130. Then, the fan 133 blows the heated air in the radial direction. The heated air in the fan housing 130 is discharged into the cooking chamber 103 through the air discharge holes 123, and thereby cooking the food in the cooking chamber 103. The air blown into the cooking chamber 103 returns to the fan housing 130 through the air suction holes 111 by the suction force of the fan 133. The returning air is heated by the convection heater 121 and transferred into the cooking chamber 103 by the fan 133, thereby forming air circulation.

However, since the convection heater is installed in the fan housing isolated from the cooking chamber and is not located on an air passageway, the heat energy of the convection heater is consumed to increase temperature of the inner side of the fan housing and the remaining heat energy is consumed to heat the air blown into the cooking chamber through the air discharge holes. Thus, there occurs a loss of heat by the amount of the heat which is used to heat the fan housing, thereby lowering efficiency of cooking in the microwave oven. Furthermore, to prevent heat from being transferred into a driving motor of the fan and an electric wire, etc., and being emitted outside of the cooking chamber and the fan housing, an insulating member is required around the convection heater, thereby increasing the cost of production.

SUMMARY OF THE INVENTION

Accordingly, an object of the present invention is to provide a microwave oven able to reduce loss of heat.

It is another object to provide a microwave oven able to improve the efficiency of cooking.

It is also an object to provide a microwave oven able to reduce the cost of production.

These and other object may be achieved by providing a microwave oven including a cooking chamber, a fan housing, both of which are isolated by a partition, and a heater housing depressed from said partition toward the fan housing and having at least one air discharge hole formed on a side of the heater housing. The air discharge hole communicates with the fan housing. A convection heater is housed in the heater housing, and a fan installed in the fan housing blows air in said fan housing into the cooking chamber through the air discharge holes and the convection heater. At least one air suction hole is formed in a central area of the partition, and the heater housing is positioned around the air discharge hole. The partition is a rear wall of the cooking chamber. The heater housing has a groove section, and the air discharge holes are formed on a sidewall of the groove section of the heater housing toward the fan.

BRIEF DESCRIPTION OF THE DRAWINGS

A more complete appreciation of the invention, and may of the attendant advantages, thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENT

Figure 1:
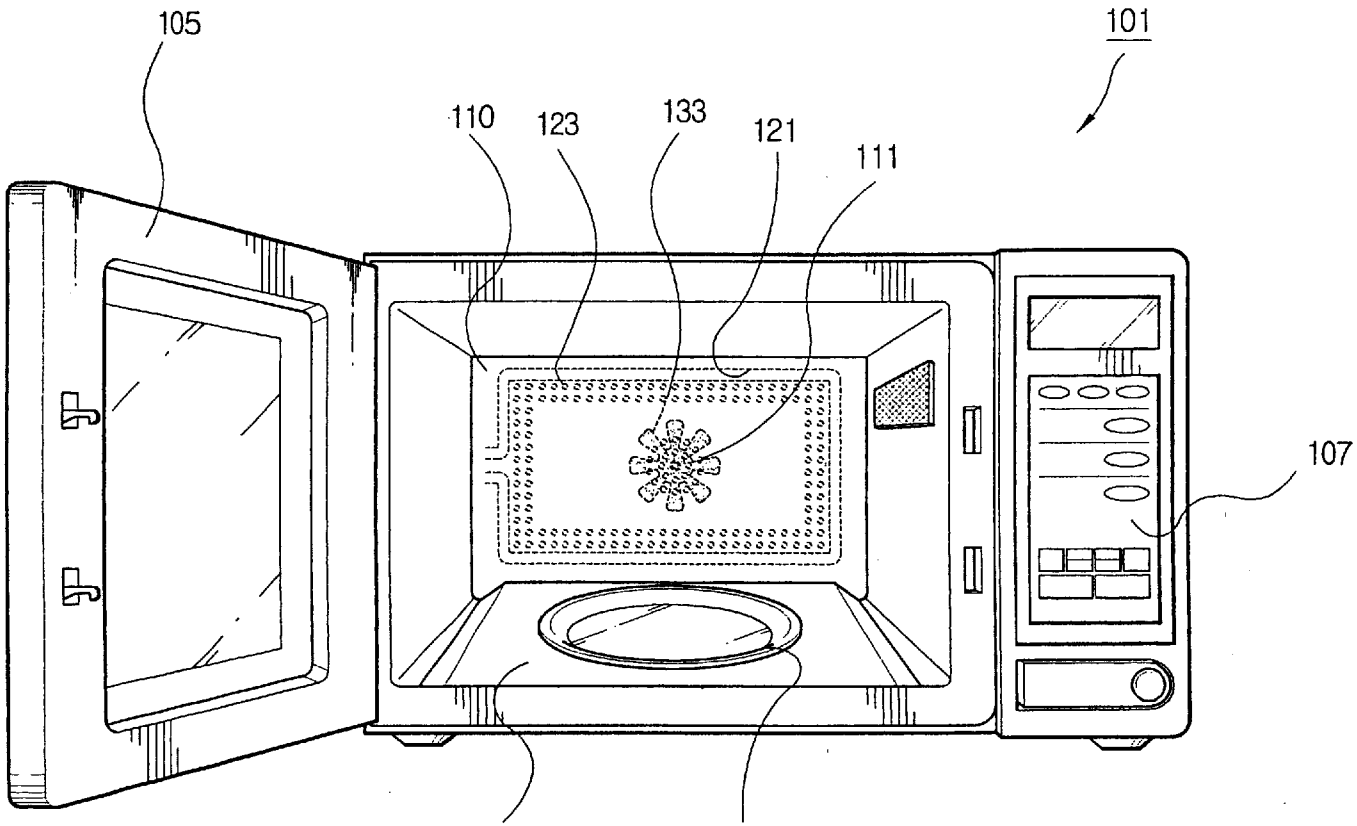
(Prior Art) Fig. 1
FIG. 1 is a perspective view of an embodiment of a conventional microwave oven.
Figure 2:
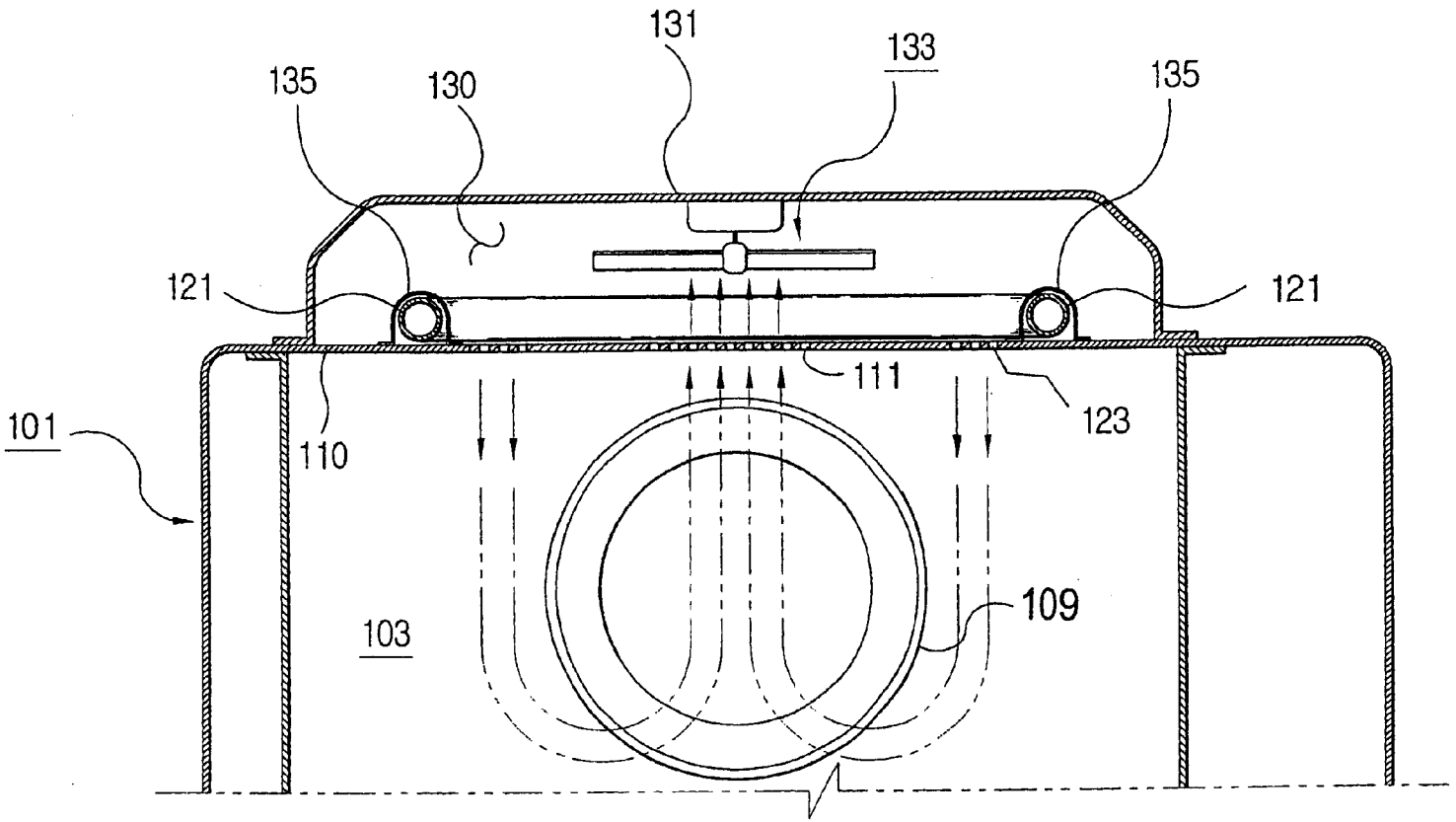
(Prior Art) Fig. 2
FIG. 2 is a cross-sectional view of a fan housing of FIG. 1.
Figure 3:
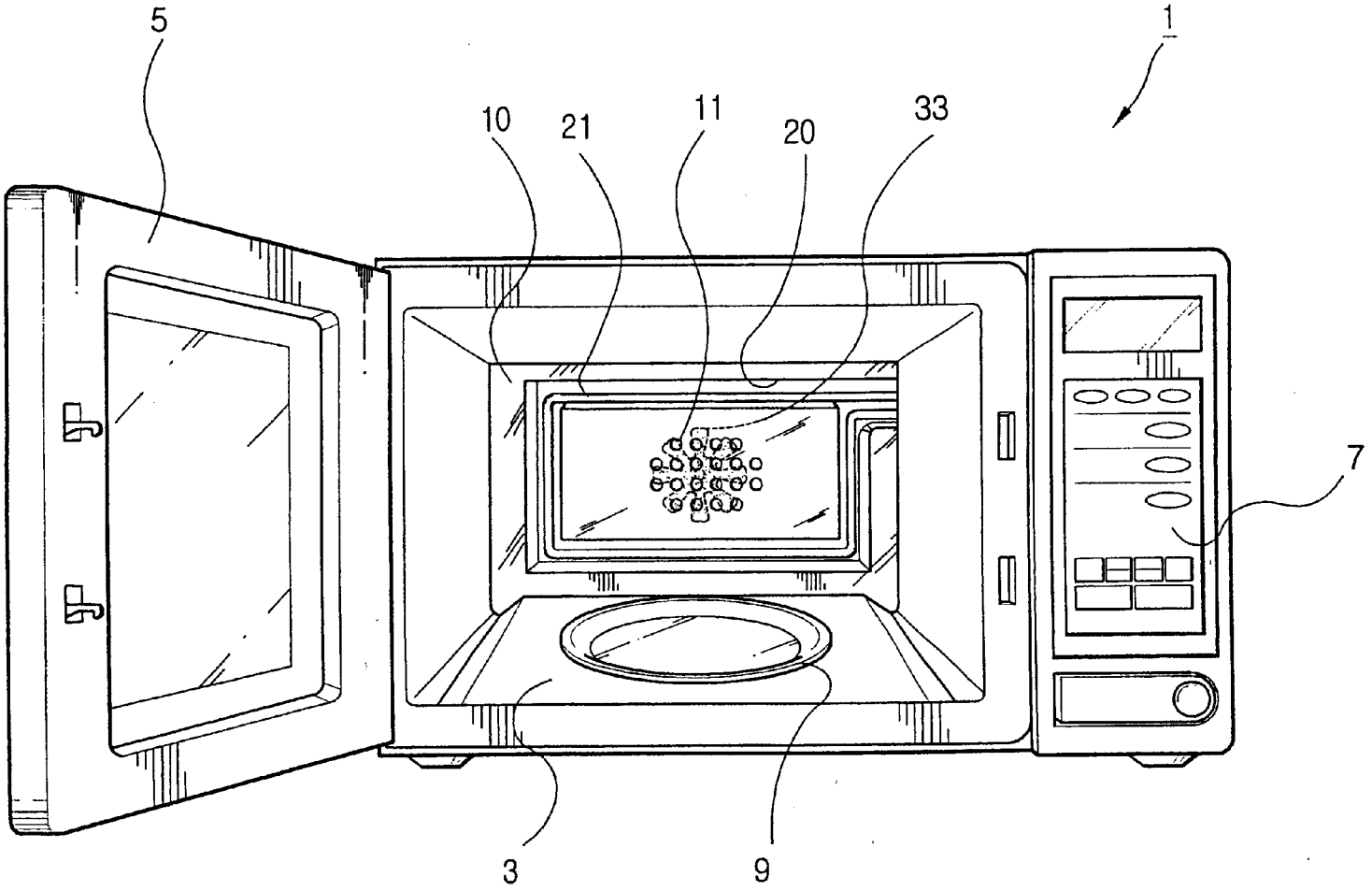
FIG. 3 is a perspective view of a microwave oven according to the present invention.
Figure 4:
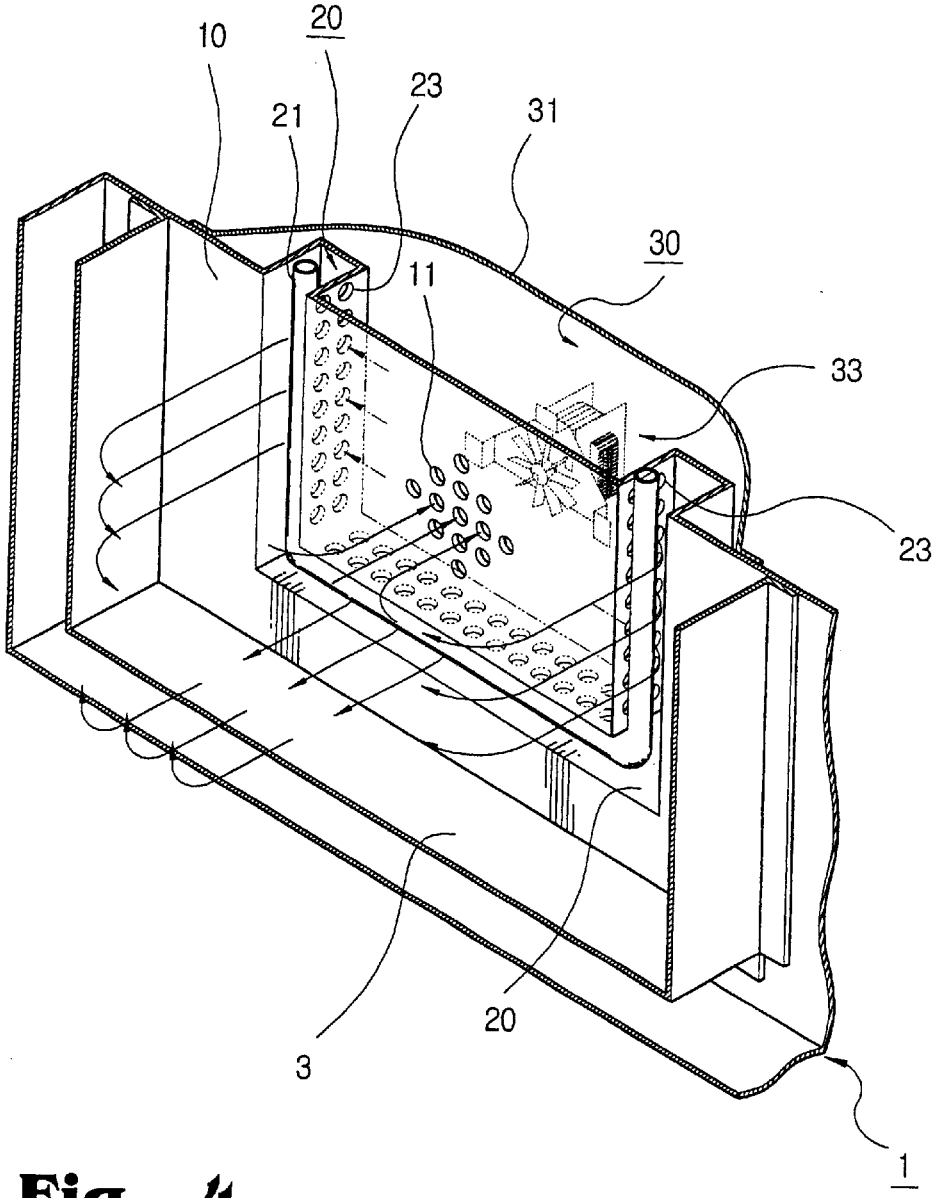
FIG. 4 is a perspective view showing partially rear area of a cooking chamber and inside of a fan housing of FIG. 3.
Figure 5:
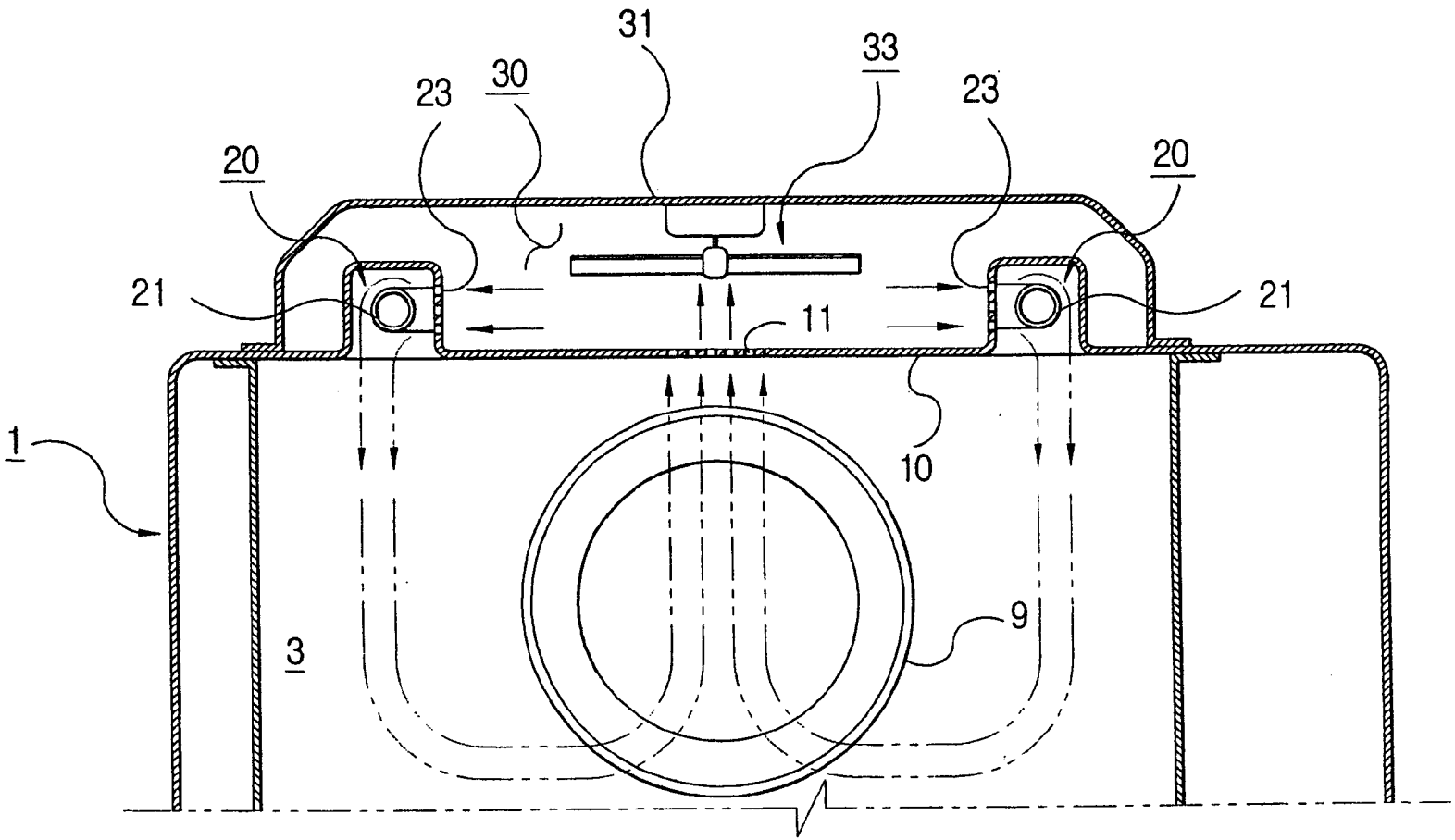
FIG. 5 is a cross-sectional view of the fan housing and the cooking chamber.

Referring now to FIGS. 3 through 5, the microwave oven according to the principle of the present invention has a main body 1 having a cooking chamber 3 into which food to be cooked is put. In the front of the main body 1 are provided a door 5 opening and closing the cooking chamber 3 and a control panel 7 operating the microwave oven. In the rear of the control panel 7 is formed a component chamber in which a variety of components operating cooking processes of the microwave oven are installed. On the bottom of the cooking chamber 3, a circular tray 9 on which the food is put is rotatably installed. The circular tray 9 is rotated by a driving motor not shown. A fan housing 30 is formed at the rear of the cooking chamber 3 and between a partition 10 and a heater casing 31. On a backside of the fan housing 30 is installed a fan 33 blowing heated air into the cooking chamber 3.

A plurality of air suction holes 1 1 are formed in the central area of the partition 10 and are in communication with the fan housing 30. A heater housing 20 is formed along the circumferential area of the partition 10 and around the air suction holes 11. The heater housing 20 having a form of loop is depressed toward the fan housing 30. Preferably, the heater housing 20 is depressed from the planar surface of the partition 10 to form a groove section.

A convection heater 21 having a form of loop is housed in the heater housing 20 along the longitudinal direction thereof. On a sidewall of the groove section of the depressed heater housing 20 are formed a plurality of air discharge holes 23 communicating with the fan housing 30, along the longitudinal direction of the heater housing 20.

With this configuration, when the microwave oven operates, the convection heater 21 housed in the heater housing 20 heats air blown from the fan housing 30 into the cooking chamber 3. Then, the fan 33 installed in the fan housing 30 blow the heated air in the radial direction of the fan 33 and toward the convection heater 21.

The heated air blown by the fan 33 flows into the cooking chamber 3 through the air discharge holes 23 formed on the sidewall of the heater housing 20. The heat generated by the convection heater 21 housed in the heater housing 20 can be transferred directly to the cooking chamber 3 by the heated air passing through the air discharge holes 23 and the convection heater 21, thereby reducing loss of heat at minimum.

The air in the cooking chamber 3 returns to the fan housing 30 through the air suction holes 11 by the suction force of the fan 33, thereby forming an air circulation between the cooking chamber 3 and the fan housing 30. The heat transferring operation from the convection heater 21 to the cooking chamber 103 is repeated by the air circulation, thereby cooking the food.

As described above, since the convection heater 21 is installed in the heater housing 20 which is formed on the partition 10 and depressed toward the fan housing 30, loss of heat generated by the convection heater 21 can be effectively decreased. Further, since the convection heater is installed inside the cooking chamber, there is no need to install an insulation member separately in the fan housing, thereby lowering cost of production.

In the embodiment according to the principle of the present invention described above, the heater housing is formed in the shape of loop in the circumferential area of the partition, but the heater housing may be formed in any manner, for example, in both upper and lower portions of the cooking chamber, or both left and right sides of the wall of the cooking chamber or either upper or lower portions, or either left or right side of the wall of the cooking chamber.

According to the present invention, there is provided a microwave oven in which loss of heat is reduced, thereby increasing the efficiency of cooking, and reducing the cost of production.

Although the present invention has been described in connection with a preferred embodiment thereof, it will be appreciated by those skilled in the art that additions, modifications, substitutions and deletions not specifically described may be made without departing from the spirit and scope of the invention as defined in the appended claims.

What is claimed is:

1. A microwave oven comprising a cooking chamber and a fan housing, both of which are isolated by a partition, the microwave oven further comprising:

a heater housing depressed from said partition toward said fan housing and having at least one air discharge hole formed thereon, the air discharge hole communicating with said fan housing;

a convection heater housed in said heater housing; and a fan installed in said fan housing, for sending air in said fan housing into the cooking chamber through the air discharge hole via said convection heater.

2. The microwave oven of claim 1, further comprising at least one air suction hole formed in the central area of said partition.

3. The microwave oven of claim 2, with said partition being a rear wall of said cooking chamber.

4. The microwave oven of claim 2, with said air discharge hole and said air suction hole formed on a different plane from each other.

5. The microwave oven of claim 1 with said heater housing positioned around said air discharge hole.

6. The microwave oven of claim 1, with said heater housing comprising a groove and said air discharge hole formed on said sidewall of said groove.

7. The microwave oven of claim 1, with said sidewall being a different plane from said partition.

8. The microwave oven of claim 1, with said heater disposed outside of said fan housing.

9. The microwave oven of claim 1, with said partition and said heater housing being made in a single body.

10. The microwave oven of claim 1, with said sidewall being perpendicular to said partition.

11. The microwave oven of claim 1, with said fan surrounded by said sidewall of said heater housing.

12. The microwave oven of claim 1, with said fan disposed within said sidewall of said heater housing.

13. A microwave oven, comprising:

a cooking chamber having a partition;

a fan housing attached to said partition, having a fan mounted on said fan housing disposed between said fan housing and said partition;

a groove formed on said partition;

at least one hole formed on a sidewall of said groove, communicating with said fan housing and said cooking chamber; and a heater disposed within said groove to heat air discharged from said fan housing through said hole.

14. The microwave oven of claim 13, with said partition comprising at least one second hole formed on said partition.

15. The microwave oven of claim 13, with said partition and said groove being made in a single body.

16. The microwave oven of claim 13, with said heater disposed outside of said fan housing.

17. The microwave oven of claim 13, with said sidewall of said groove surrounding said fan mounted on said fan casing.

18. The microwave oven of claim 13, with said sidewall of said groove having a predetermined angle with said partition.

19. The microwave oven of claim 13, wherein the air discharged through said hole is blown into said cooking chamber after heated by said heater.

20. The microwave oven of claim 13, with said groove comprising an opening, the air heated by said heater and discharged through said opening into said chamber.

* * * * *